US010868367B2

(12) United States Patent
Lee et al.

(10) Patent No.: US 10,868,367 B2
(45) Date of Patent: Dec. 15, 2020

(54) ANTENNA APPARATUS

(71) Applicant: Samsung Electronics Co., Ltd., Suwon-si (KR)

(72) Inventors: Seung-Bok Lee, Hwaseong-si (KR); Dong-yean Koh, Suwon-si (KR); Sang-hyuk Wi, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/342,108

(22) PCT Filed: Oct. 18, 2017

(86) PCT No.: PCT/KR2017/011545
§ 371 (c)(1),
(2) Date: Apr. 15, 2019

(87) PCT Pub. No.: WO2018/080098
PCT Pub. Date: May 3, 2018

(65) Prior Publication Data

US 2019/0260136 A1 Aug. 22, 2019

(30) Foreign Application Priority Data

Oct. 31, 2016 (KR) ..... 10-2016-0143406

(51) Int. Cl.
*H01Q 19/12* (2006.01)
*H01Q 1/38* (2006.01)
(Continued)

(52) U.S. Cl.
CPC ..... *H01Q 19/12* (2013.01); *H01Q 1/24* (2013.01); *H01Q 1/38* (2013.01); *H01Q 3/01* (2013.01);
(Continued)

(58) Field of Classification Search
None
See application file for complete search history.

(56) References Cited

U.S. PATENT DOCUMENTS 5,182,564 A * 1/1993 Burkett ..... F41G 7/008 342/53
6,317,095 B1 * 11/2001 Teshirogi ..... H01Q 3/24 343/770

(Continued)

FOREIGN PATENT DOCUMENTS

| | | |
|---|---|---|
| JP | 6-204737 | 7/1994 |
| KR | 10-0802895 | 2/2008 |
| KR | 10-2014-0049482 | 4/2014 |

OTHER PUBLICATIONS

International Search Report dated Feb. 13, 2018, in corresponding International Patent Application No. PCT/KR2017/011545.

(Continued)

*Primary Examiner* — Crystal L Hammond
(74) *Attorney, Agent, or Firm* — Staas & Halsey LLP

(57) ABSTRACT

An antenna apparatus includes: an antenna module having a radiation-oriented surface in a first direction to transmit and receive a radio signal; and a radio-wave reinforcement member arranged in a second direction opposite to the first direction within a preset distance from the antenna module to amplify radiation performance of the antenna module, and including an electric conductor having a curved surface concave to the antenna module.

8 Claims, 8 Drawing Sheets

(51) Int. Cl.

| | |
|---|---|
| ***H01Q 3/36*** | (2006.01) |
| ***H01Q 19/17*** | (2006.01) |
| ***H01Q 19/18*** | (2006.01) |
| ***H01Q 3/26*** | (2006.01) |
| ***H01Q 3/24*** | (2006.01) |
| ***H01Q 1/24*** | (2006.01) |
| ***H01Q 3/01*** | (2006.01) |

(52) U.S. Cl.
CPC ..... *H01Q 3/24* (2013.01); *H01Q 3/26* (2013.01); *H01Q 3/36* (2013.01); *H01Q 19/17* (2013.01); *H01Q 19/18* (2013.01)

(56) References Cited

U.S. PATENT DOCUMENTS

| | | | | |
|---|---|---|---|---|
| 7,728,782 | B2 | 6/2010 | Watson et al. | |
| 8,284,102 | B2 * | 10/2012 | Hayes | H01Q 1/38 342/372 |
| 9,685,689 | B1 * | 6/2017 | Etzkorn | H01Q 1/248 |
| 2004/0257290 | A1 | 12/2004 | Gothard et al. | |
| 2008/0238795 | A1 | 10/2008 | Alamouti et al. | |
| 2010/0007781 | A1 * | 1/2010 | Segami | H04N 5/335 348/311 |
| 2011/0018651 | A1 * | 1/2011 | Ikeda | H01P 5/12 333/118 |
| 2015/0346334 | A1 * | 12/2015 | Nagaishi | H01Q 1/421 342/115 |
| 2016/0264078 | A1 * | 9/2016 | McGuire, Jr. | H01Q 1/3275 |

OTHER PUBLICATIONS

Yang et al., "Transformation-optical Fan-beam Synthesis," Scientific Reports, 6, 20530; doi: 10.1038/srep20530, Feb. 5, 2016.

* cited by examiner

ANTENNA APPARATUS

CROSS-REFERENCE TO RELATED APPLICATIONS

This application is a U.S. National Stage Application which claims the benefit under 35 U.S.C. § 371 of PCT International Patent Application No. PCT/KR2017/011545 filed on Oct. 18, 2017, which claims the foreign priority benefit under 35 U.S.C. § 119 of Korean Patent Application No. 10-2016-0143406 filed on Oct. 31, 2016, the contents of which are incorporated herein by reference.

TECHNICAL FIELD

The disclosure relates to an antenna apparatus to be used in transmitting/receiving a predetermined radio signal, and more particularly to an antenna apparatus having an improved structure to enhance radiation performance of an antenna module in transmitting/receiving a millimeter wave (mmWave) or the like super-high frequency signal such as an through the antenna module.

BACKGROUND ART

To calculate and process predetermined information according to a specific process, an electronic apparatus basically including electronic parts such as a central processing unit (CPU) for calculation, a chipset, a memory, and the like may be classified into various types depending on what is the information to be subjected to the process. For example, the electronic apparatus is classified into an information processing apparatus such as a personal computer (PC), a server, and the like to process universal information, and an image processing apparatus to process image information. The image processing apparatus displays an image based on processed image data on its own display, or outputs the processed image data to a separate external apparatus having a display so that the external apparatus can display the image. As an example of the image processing device having no display, there is a set-top box. In particular, an image processing apparatus having the display will be called a display apparatus, and includes a TV, a portable multimedia player, a tablet computer, a mobile phone, etc. by way of example.

The foregoing apparatuses perform operations needed for processing a predetermined signal by transmitting and receiving the signal to and from external apparatuses through a network rather than being operated in standing alone. The signal may be transmitted by wired communication, but technology has been developed towards using wireless communication to transmit the signal. As representative technology for wireless signal transmission, there is an antenna.

In the wireless communication, a signal is transmitted through a free space. The antenna not only radiates a signal into the free space, but also serves as an end terminal to capture a signal radiated into the free space. The antenna may be actualized as an independent apparatus, or may be present as a sub element of a main apparatus such as the image processing apparatus.

However, frequency depletion due to current increase in use of the wireless communication, and the like phenomena cause necessity of using a signal of a mmWave or the like super-high frequency band. Because a wavelength of a signal is inversely proportional to a frequency, characteristics of a radio wave are changed as the frequency becomes higher. This may make a problem arise when the existing antenna having a structure for a signal of a relatively low frequency band is employed in transmitting and receiving the mmWave.

Accordingly, an antenna for transmitting and receiving the mmWave or the like signal may be required to have an improved structure for enhancing radiation performance.

DISCLOSURE

Technical Solution

The foregoing object of the disclosure is achieved by providing an antenna apparatus including: an antenna module having a radiation-oriented surface in a first direction to transmit and receive a radio signal; and a radio-wave reinforcement member arranged in a second direction opposite to the first direction within a preset distance from the antenna module to amplify radiation performance of the antenna module, and including an electric conductor having a curved surface concave to the antenna module. Thus, the antenna apparatus is improved in performance of transmitting and receiving the radio signal by reinforcing the radiation performance at the left and right sides with respect to the antenna module that transmits and receives an mmWave and supports the beamforming.

The preset distance between the electric conductor and the antenna module may not exceed a focal distance of the curved surface.

The preset distance between the electric conductor and the antenna module may be provided to correspond to a radiation length of the antenna module and a wavelength corresponding to an operation frequency of the antenna module. Thus, the antenna apparatus has the coupling effect based on the electric conductor and the antenna module.

The antenna module may include a phased array antenna including a plurality of antenna devices arranged to be spaced apart from each other. Thus, the antenna module achieves the beamforming.

The antenna module may be provided to transmit and receive the radio signal based on a millimeter wave.

The antenna apparatus may further include a control circuit configured to individually adjust a phase of a voltage applied to the plurality of antenna devices.

The radio-wave reinforcement member may include a plurality of electric conductors, and the plurality of electric conductors may be different in curvature from each other. Thus, the antenna apparatus is considerably improved in the radiation performance of the antenna module by maximizing the coupling effect based on the electric conductors.

The curved surfaces of the plurality of electric conductors may have different central axial lines with respect to the antenna module. Thus, the antenna apparatus prevents the coupling effect based on the electric conductors from interference.

The radio-wave reinforcement member may include a base including a dielectric; a first electric conductor formed on a front surface of the base facing the antenna module and having a first curvature; and a second electric conductor formed on a back surface of the base opposite to the front surface of the base and having a second curvature.

BEST MODE

Below, embodiments of the disclosure will be described in detail with reference to accompanying drawings. In the following descriptions of the embodiments, the matters illustrated in the accompanying drawings will be referred. Further, in the embodiments, the components having the direct relation and the concept of the disclosure only will be described, and the description about remaining components except for this will be omitted. However, it will be understood that such omitted components are not unnecessary in terms of realizing an apparatus or system to which the concept of the disclosure is applied. In the following embodiments, it will be understood that terms 'include' or 'have' are to specify the presence of features, numbers, steps, operations, elements, components or combination thereof described in the disclosure without precluding the presence or addition of one or more other features, numbers, steps, operations, elements, components or combination thereof.

Further, the embodiments described with reference to the accompanying drawings are not exclusive to each other unless otherwise mentioned, and a plurality of embodiments may be selectively combined within one apparatus. The combination of these embodiments may be discretionally selected and applied to realize the present inventive concept by a person having an ordinary skill in the art.

Figure 1:
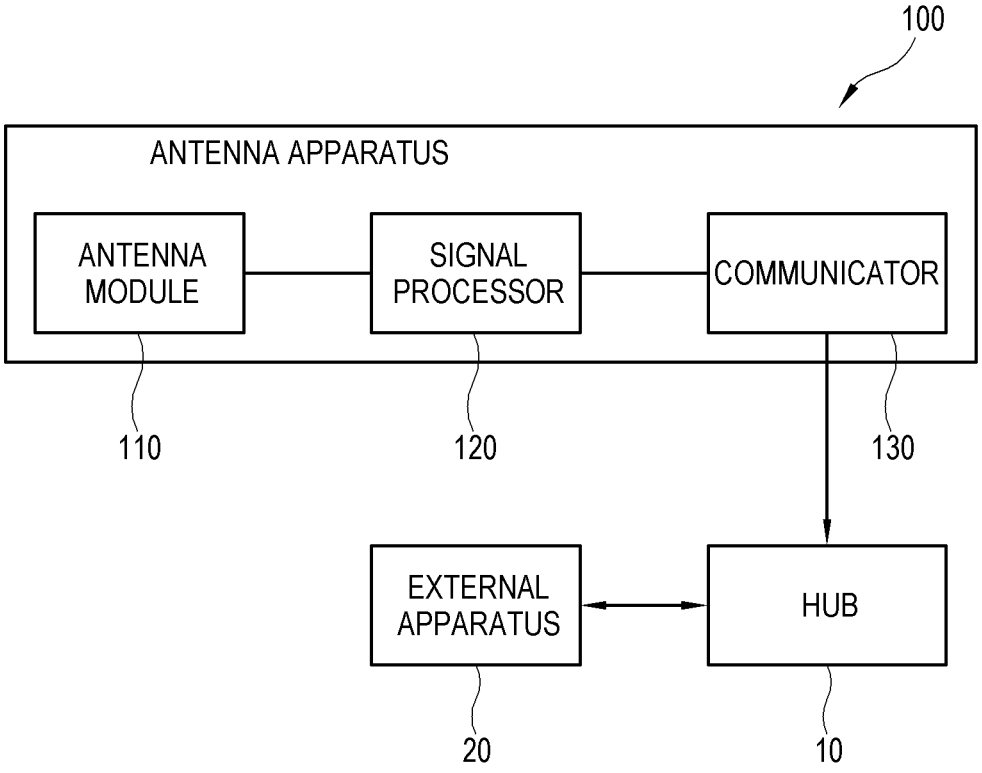
FIG. 1 is a block diagram of an antenna apparatus according to an embodiment of the disclosure.

FIG. 1 is a block diagram of an antenna apparatus according to an embodiment of the disclosure.

As shown in FIG. 1, an antenna apparatus 100 according to an embodiment includes an antenna module 110 to wirelessly receive a signal propagating through a free space, a signal processor 120 to process the signal received in the antenna module 110, and a communicator 130 to output the signal processed by the signal processor 120 to the outside. The antenna apparatus 100 not only receives a signal but also transmits a signal. For example, the signal processor 120 processes a signal received in the communicator 130, and the antenna module 110 radiates the processed signal to the free space to thereby transmit the signal.

The antenna module 110 includes one or more antenna devices to transmit and receive a signal. In this embodiment, the antenna module 110 is configured to transmit and receive a signal of a super-high frequency band equal to or higher than 30 GHz, i.e. a millimeter wave (mmWave). The mmWave refers to a signal of a frequency band of 30 to 300 GHz, which has a wavelength of just 1 to 10 mm.

Basically, a wavelength of a signal becomes shorter as the signal more oscillates. Therefore, the mmWave propagates with very high straightness, and makes a signal have relatively high quality. On the other hand, many oscillations may make it relatively difficult to propagate far away. As one of reasons why the mmWave is used, there is a frequency depletion problem. It is hard to deliver a huge amount of information at the existing frequency of 10 GHz or below. To solve such a problem, the mmWave has been proposed. Besides, the mmWave has been on the rise because it has great advantages of high security and less interference due to a range of several meters.

To receive the mmWave having a relatively short wavelength and a relatively high frequency, the antenna module 110 has to have a relatively high radiation gain in a direction in which a signal is expected to be received, for example, a frontward direction of the antenna module 110. In an electric field strength curve of an electromagnetic wave omnidirectionally radiated 360 degree from the antenna module 110, the electric field strength curve is relatively long with regard to a radiation-oriented direction of the antenna module 110.

The electric field strength curve with regard to the radiation-oriented direction, for example, a forward direction of the antenna module 110 is called a main lobe. The electric field strength curve of leftward and rightward directions with regard to the radiation-oriented direction, of the antenna module 110 is called a side lobe, and the electric field strength curve of an opposite, i.e. backward direction to the radiation-oriented direction of the antenna module 110 is called a back lobe.

However, the width of the main lobe has to be enlarged by widening an azimuth of a corresponding direction in order to expand a range of receiving a signal with normal quality. To this end, a beamforming function is required. The antenna module 110 includes a phased array antenna supporting the beamforming function. The structure of the phased array antenna will be described later.

The signal processor 120 may be actualized by combination of a chipset, a microprocessor, a CPU, etc., by a circuit structure, or by a system on chip (SoC). The signal processor 120 is configured to support various functions in accordance with demands on the antenna apparatus 100. For example, the signal processor 120 may support modulation and demodulation functions, i.e. may demodulate a signal received in the antenna module 110 to thereby transmit the demodulated signal to the outside through the communicator 130, and modulate a signal received through the communicator 130 to thereby transmit the modulated signal to the antenna module 110.

The communicator 130 includes a communication interface circuit to transmit and receive a signal to and from the outside. For example, the communicator 130 includes a wired port to which a cable is connected, a wireless communication chipset for wireless communication, etc. When the communicator 130 includes the wireless communication chipset, the communicator 130 connects with a hub 10 by a communication method such as Wi-Fi, Bluetooth, etc., and communicate with an external apparatus 20 such as a TV, home appliances, other electronic devices, etc. through the hub 10.

The hub 10 refers to an apparatus for relaying communication between various external apparatuses 20 within the system including the antenna apparatus 100, and there are no limits to the kinds of hub. For example, the hub 10 may be actualized by an apparatus such as an access point (AP), a router, Internet of things (IoT) hub, etc.

In this embodiment, an independent antenna apparatus 100 including the antenna module 110 is described, but the concept of the disclosure is not limited to this. Although it will be described later through the following embodiments, the concept of the disclosure is to improve the radiation performance of the antenna module 110 and is not limited to only a case where the antenna module 110 is actualized by an independent apparatus. For example, the concept of the disclosure is applicable to even the antenna module mounted to an image processing apparatus such as a TV or a set-top box.

Below, the structure of the antenna module 110 will be described.

Figure 2:
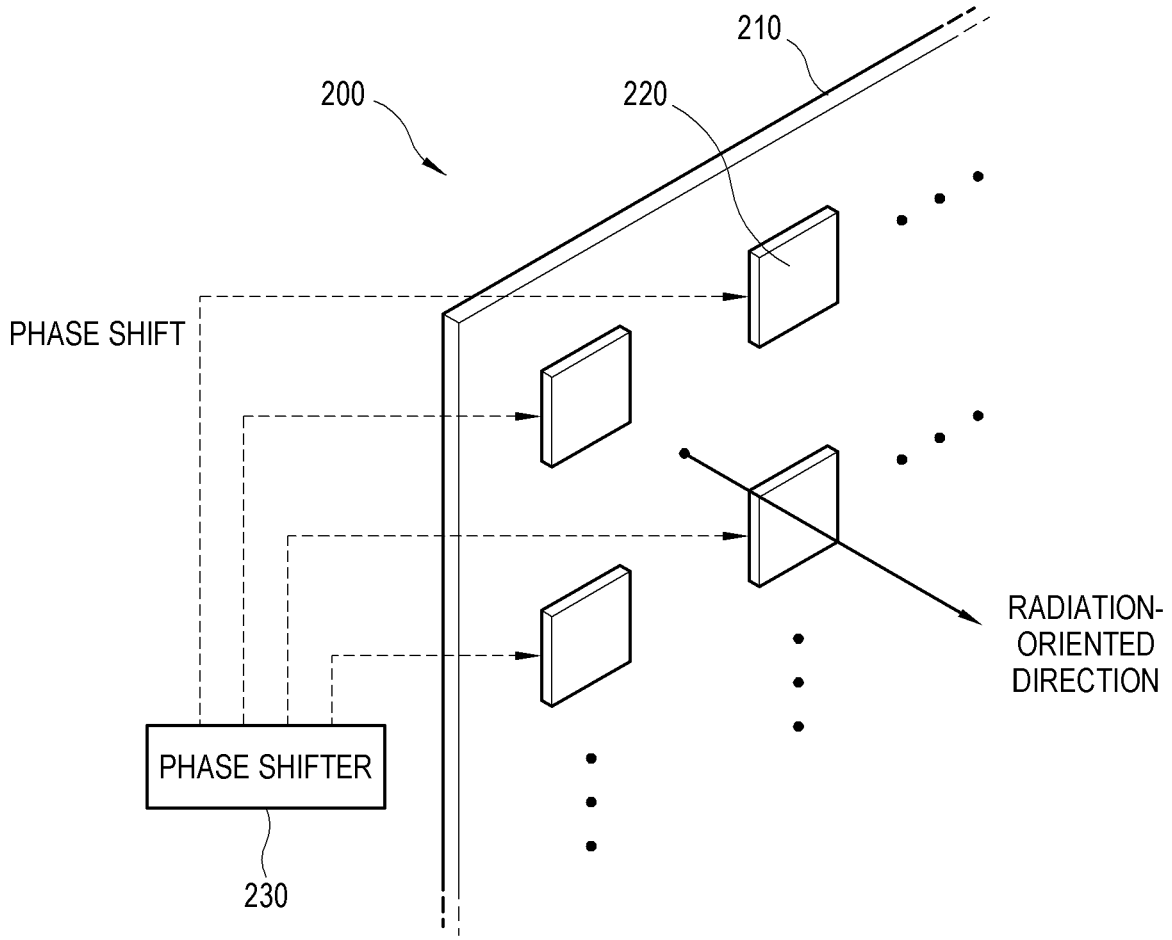
FIG. 2 illustrates an example partially showing a structure of an antenna module according to an embodiment of the disclosure.

FIG. 2 illustrates an example partially showing a structure of an antenna module according to an embodiment of the disclosure.

As shown in FIG. 2, an antenna module 200 is actualized by a phased array antenna of supporting the beamforming function, and includes a substrate 210, and a plurality of antenna devices 220 arranged being spaced apart from each other on one side of the substrate 210. The plurality of antenna devices 220 is provided as an electric conductor for transmitting and receiving a signal, and arranged on one side of the substrate 210 in a direction where the antenna module 200 is oriented to transmit and receive a signal. That is, the antenna device 220 is arranged on the substrate 210 in the radiation-oriented direction of the antenna module 200, and shows a long main lobe with regard to the radiation-oriented direction when the electric field strength is measured.

The number of antenna devices 220 mounted on to the substrate 210, the arranged shape of the plurality of antenna devices 220, a distance between two adjacent antenna devices 220, etc. may be varied depending on characteristics of a signal transmitted by and received in the antenna module 200, and are not construed as limiting the concept of the disclosure.

When the phases of the antenna devices 220 are adjusted toward one direction in such a state that the plurality of antenna devices 220 is configured in the form of the array, a radiation gain becomes stronger in the corresponding direction. That is, when the phase of every antenna device 220 is adjustable, a direction where the radiation gain of the antenna module 200 is relatively strong is controllable based on the phase adjustment.

A phase shifter 230 electronically shifts the phase of the voltage or current, applied to each antenna device 220, at high speed to thereby actualize the beamforming. That is, the phase shifter 230 makes the phase of each antenna device 220 be varied to thereby control a direction where the transceiving sensitivity of the antenna module 200 is relatively high. When the electric field strength is measured while the phase shifter 230 makes the phases of the antenna devices 220 be varied in sequence, a long main lobe is shown throughout a predetermined angle range with respect to the radiation-oriented direction. Here, the radiation-oriented direction refers to a direction of a normal to the plane of the substrate 210 to which the plurality of antenna devices 220 is mounted.

Thus, the antenna module 200 has the structure of the phased array antenna and thus secures performance of receiving a signal of a frequency band corresponding to the mmWave in the radiation-oriented direction.

However, the antenna module 200 with such a structure secures the radiation gain in the radiation-oriented direction, but has a relatively low radiation gain at the left and right sides of the radiation-oriented direction. On the graph of the electric field strength, the main lobe in the radiation-oriented direction with respect to an axial line at an azimuth of 0 degrees is represented as a relatively long curve, but the side lobes between left and right axial lines of about 60 degrees with respect to the axial line of 0 degrees are represented as relatively short curves. This means that performance of receiving a signal is relatively degraded in the left and right directions of about 60 degrees.

To solve this problem, the antenna module 200 may be required to have a structure or method of reinforcing the radiation gain at the side lobes.

Meanwhile, the related art has disclosed a structure where a reflection plate having a predetermined curvature is installed in an opposite direction to the radiation-oriented direction of the antenna module. The antenna module of the related art does not necessarily have the structure of the phased array antenna. Such a structure of the related art has been designed to relatively narrow a signal receiving angle in accordance with the curvature of the reflection plate and maximize a receiving gain of the antenna module. In general, the structure of this related art has a narrow operation angle of less than 30 degrees, but has a high radiation gain of more than 30 dBi.

Although the structure of this related art has the high radiation gain, its azimuth coverage is narrow. Therefore, the structure of this related art is not suitable for an mmWave field of an in-room environment where both the high radiation gain and the wide azimuth coverage are required.

Below, it will be described that the antenna module 200 according to an embodiment of the disclosure has a structure for reinforcing the radiation gain at the side lobes.

Figure 3:
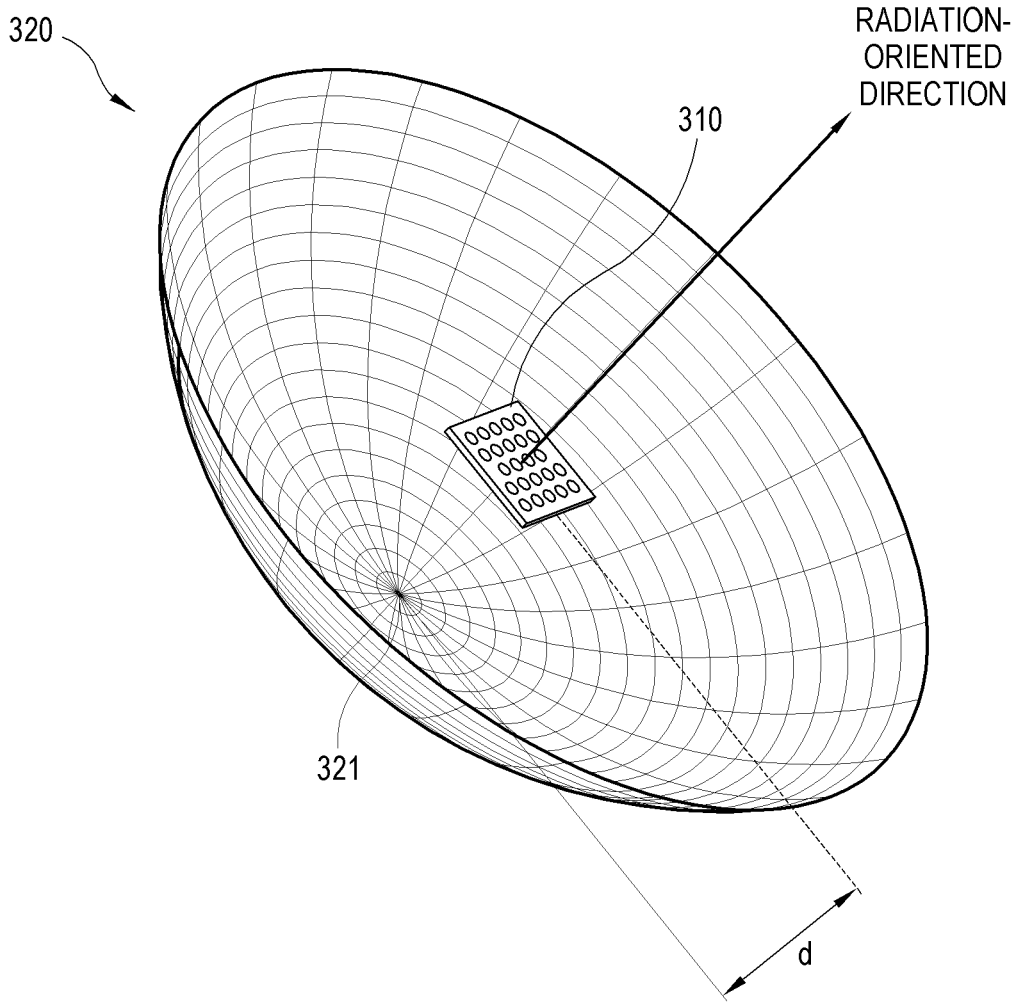
FIG. 3 is a perspective view of a reinforcement member arranged to reinforce a radiation gain of an antenna module according to an embodiment of the disclosure.

FIG. 3 is a perspective view of a reinforcement member arranged to reinforce a radiation gain of an antenna module according to an embodiment of the disclosure.

As shown in FIG. 3, an antenna module 310 has the phased array antenna, the structure of which is the same as described above. The radiation-oriented direction of electromagnetic waves for transmitting and receiving a signal is varied depending on where the surface of the antenna module 310 is oriented.

According to an embodiment, a hemispheric radio-wave reinforcement or radiation reinforcement member 320 is installed behind the antenna module 310. The radiation reinforcement member 320 is arranged in the opposite direction to the radiation-oriented direction of the antenna module 310. In other words, the radiation reinforcement member 320 is arranged at the opposite side to the radiation-oriented surface of the antenna module 310. The radiation reinforcement member 320 is arranged to surround the back of the antenna module 310 with its concave surface.

The radiation reinforcement member 320 contains metal or the like electric conductor in at least a portion of a curved surface surrounding the antenna module 310. Of course, the radiation reinforcement member 320 may be entirely formed with the electric conductor on the entire curved surface. When a portion of the radiation reinforcement member 320 includes the electric conductor, the other portion may include a dielectric. The radiation reinforcement member 320 may be formed with the electric conductor in a partial area of the curved surface surrounding the antenna module 310 and the dielectric in the other area of the curved surface, or may have a structure where the outside of the dielectric is coated with the electric conductor.

According to an embodiment, the radiation reinforcement member 320 is shaped like a hemisphere having a single curvature. In this case, a distance d between the radiation reinforcement member 320 and the antenna module 310 does not exceed a preset distance on the axial line, which passes through a center 321 of the radiation reinforcement member 320, in the radiation-oriented direction of the antenna module 310. For example, the distance d does not exceed a focal distance that the curved surface of the radiation reinforcement member 320 has, thereby making the radiation reinforcement member 320 improve a radiation gain effect at the left and right sides of the antenna module 310.

Here, detailed definition of the distance d for improving the radiation gain effect is as follows. The distance d is within a range of a near-field that the antenna module 310 has. When a radiation distance of the antenna module 310 is D and a wavelength corresponding to an operation frequency is Λ, the near field is defined by (2D^2)/Λ. For example, when the antenna module 310 receives a signal of a frequency band of 60 GHz, the near field may be defined within a region having an diameter of about 11 cm and centering upon the antenna module 310. In this case, the distance d is within a radius of 6.5 cm.

When the structure of the phased array antenna is applied to the antenna module 310, the radiation length D of the antenna may indicate the area of the antenna module 310.

Typically, the near field radiation loss in the radiation performance of the antenna does little to contribute to the transceiving performance of the antenna. In this embodiment, the electric conductor, i.e. the radiation reinforcement member 320 is arranged in the near field region of the antenna module 310, thereby changing the side radiation performance of the antenna module 310 without degrading the existing radiation performance. This is because a coupling effect of an electromagnetic wave between the antenna module 310 and the radiation reinforcement member 320 within the near field results in improving the radiation performance of the antenna module 310.

Thus, according to an embodiment, only the installation of the radiation reinforcement member 320 is enough to improve the side radiation performance of the antenna module 310 without changing the structure or control of the antenna module 310.

Figure 4:
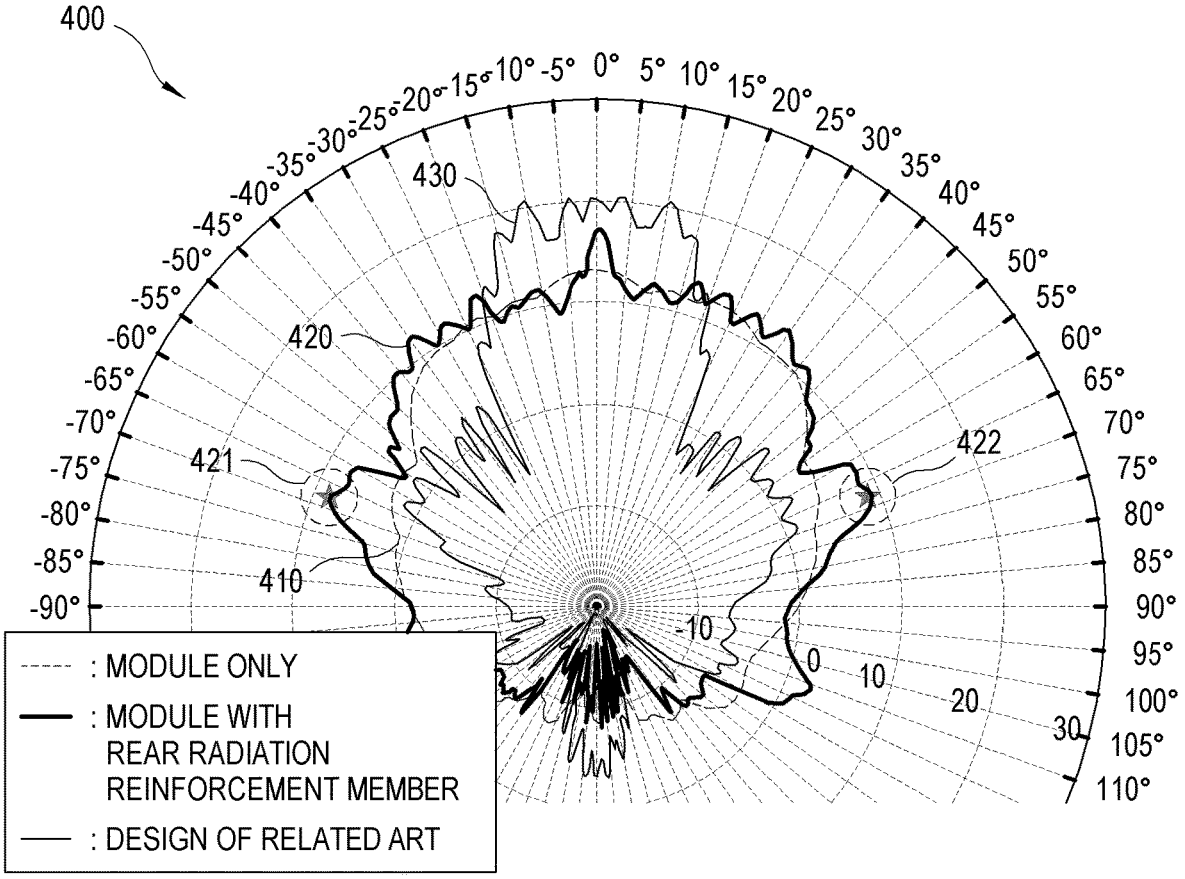
FIG. 4 is a graph of electric field strength to show effects of a structure of a radiation reinforcement member and an antenna module according to an embodiment of the disclosure.

FIG. 4 is a graph of electric field strength to show effects of a structure of a radiation reinforcement member and an antenna module according to an embodiment of the disclosure.

As shown in FIG. 4, the electric field strength graph 400 of the antenna may be drawn. The electric field strength graph 400 shows a curve corresponding to the electric field strength of the antenna on azimuthal coordinates, and it is thus possible to determine the radiation gain of the antenna. On the azimuthal coordinates of the electric field strength graph 400, a central axial line passing through an angle of 0 degrees indicates a major radiation-oriented direction of the antenna module, and a curved line within a predetermined range at left and right sides with respect to the central axial line forms the main lobe. Further, on the azimuthal coordinates, a negative angle indicates a leftward direction, and a positive angle indicates a rightward direction.

On this graph 400, there are three curves 410, 420 and 430. The first curve 410 indicates the electric field strength of when the antenna module is used solely, the second curve 420 indicates the electric field strength of when both the antenna module and the radiation reinforcement member are used according to an embodiment of the disclosure, and the third curve 430 indicates the electric field strength of when the structure of the related art, in which the reflection plate having a predetermined curvature is installed in the opposite direction to the radiation-oriented direction of the antenna module, is used. This graph 400 is given for comparison in the electric field strength among three curves 410, 420 and 430, and thus descriptions about experimental conditions will be omitted.

First, the first curve 410 shows that the lengths of the side lobes at the left and right sides are relatively short as compared with the length of the main lobe with respect to the center point of the azimuthal coordinates. This means that the radiation gains at the left and right sides of the antenna module are relatively degraded as compared with the radiation gain in front of the antenna module when only the antenna module is used solely.

The second curve 420 is based on the structure according to an embodiment of the disclosure to solve such problems of the first curve 410. In the second curve 420, the main lobe shows presence of ripples, but has an approximately similar length to that of the first curve 410. Meanwhile, the lengths of the side lobes 421 at the left and the right sides of the second curve 420 are much longer than those of the first curve 410. In particular, the lengths of the side lobes 421 are relatively increased within an azimuthal range of 60 to 70 degrees at the left and right sides of the second curve 420.

This means that the structure for reinforcing the radiation performance of the antenna module with the radiation reinforcement member according to an embodiment of the disclosure considerably improves the radiation performance in the leftward and rightward directions, in which the radiation performance was relatively poor, together with keeping the radiation performance in the radiation-oriented direction, as compared with the case where only the antenna module is solely used.

On the other hand, the third curve 430 is based on the structure where the curved surface of the reflection plate is arranged in the radiation-oriented direction of the antenna module according to the related art, in which the main lobe is long with a comparatively narrow width and the side lobes are comparatively short. This means that the radiation performance is good in a specific azimuthal range, but the radiation performance is very poor in the other azimuthal range. Therefore, the related art is hardly applicable when good radiation performance is required with regard to a large azimuthal range.

Meanwhile, the curvature of the radiation reinforcement member may have various values according to characteristics and designs needed for the antenna module. Although the concept of the disclosure is not limited to a specific value of the curvature, the curvature is determined by taking the characteristics and designs of the antenna module into account because the electric field strength is varied depending on the curvature.

Figure 5:
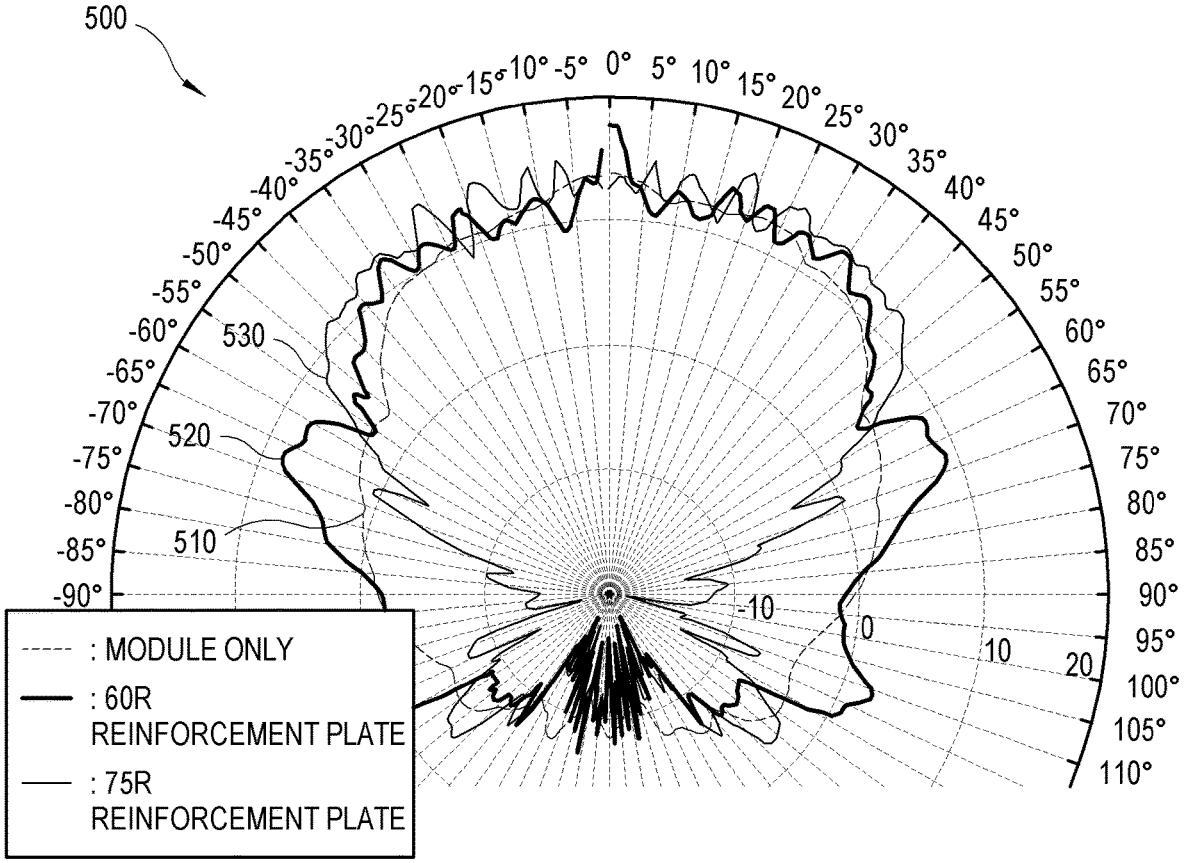
FIG. 5 is a graph of electric field strength to show differences according to curvatures of a radiation reinforcement member according to an embodiment of the disclosure.

FIG. 5 is a graph of electric field strength to show differences according to curvatures of a radiation reinforcement member according to an embodiment of the disclosure.

As shown in FIG. 5, the electric field strength graph 500 of the antenna may be drawn. Fundamental descriptions about the electric field strength graph 500 have already been made in the foregoing embodiment.

The electric field strength graph 500 includes three curves 510, 520 and 530. The first curve 510 indicates the electric field strength of when the antenna module is used solely, the second curve 520 indicates the electric field strength of when the radiation reinforcement member having a curvature radius of 60 mm is applied to the antenna module, and the third curve 530 indicates the electric field strength of when the radiation reinforcement member having a curvature radius of 75 mm is applied to the antenna module.

The first curve 510 shows that the side lobes at the left and right sides are relatively short as compared with the length of the main lobe. On the other hand, the second curve 520, to which the radiation reinforcement member is applied, shows that the main lobe has an approximately similar length to that of the first curve 510 but the side lobes are more remarkably reinforced than those of the first curve 510. In particular, the second curve 520 shows an improved radiation gain in an azimuthal range of 60 to 70 degrees at the left and right sides.

However, the third curve 530, to which the radiation reinforcement member is applied but a different curvature from the second curve 520 is applied, shows a different pattern from the second curve 520. The third curve 530 shows that there are no great differences in the main lobe from the first curve 510 and the second curve 520, but the side lobes are hardly reinforced unlike those of the second curve 520. Specifically, the third curve 530 shows that reinforcement is made a little in an azimuthal range of 30 to 50 degrees at the left and right sides as compared with that of the first curve 510, and the radiation gain is rather degraded in an azimuthal range of 60 to 70 degrees at the left and right sides as compared with the first curve 510.

Therefore, the curvature is determined taking such matters into account when the radiation reinforcement member is designed or manufactured. That is, simply placing the radiation reinforcement member within the near field of the antenna module is not enough to remarkably have the foregoing coupling effect. For example, when the radiation reinforcement member is approximately flat, there is little effect on reinforcing the radiation gain in the side lobes. On the other hand, when the radiation reinforcement member has a curvature radius not greater than a predetermined value, i.e. has a relatively large curvature, there is an effect on reinforcing the radiation gain in the side lobes.

Therefore, the radiation reinforcement member is provided to microscopically have a partially flat surface, but macroscopically have a substantial curvature.

In the foregoing embodiments, the radiation reinforcement member has a single curvature. However, the concept of the disclosure is not limited to such embodiments, and the radiation reinforcement member may be provided with surfaces which are different in curvature and are spaced apart from or overlap with each other. With this structure, the coupling effect is maximized to thereby improve the radiation gain.

Figure 6:
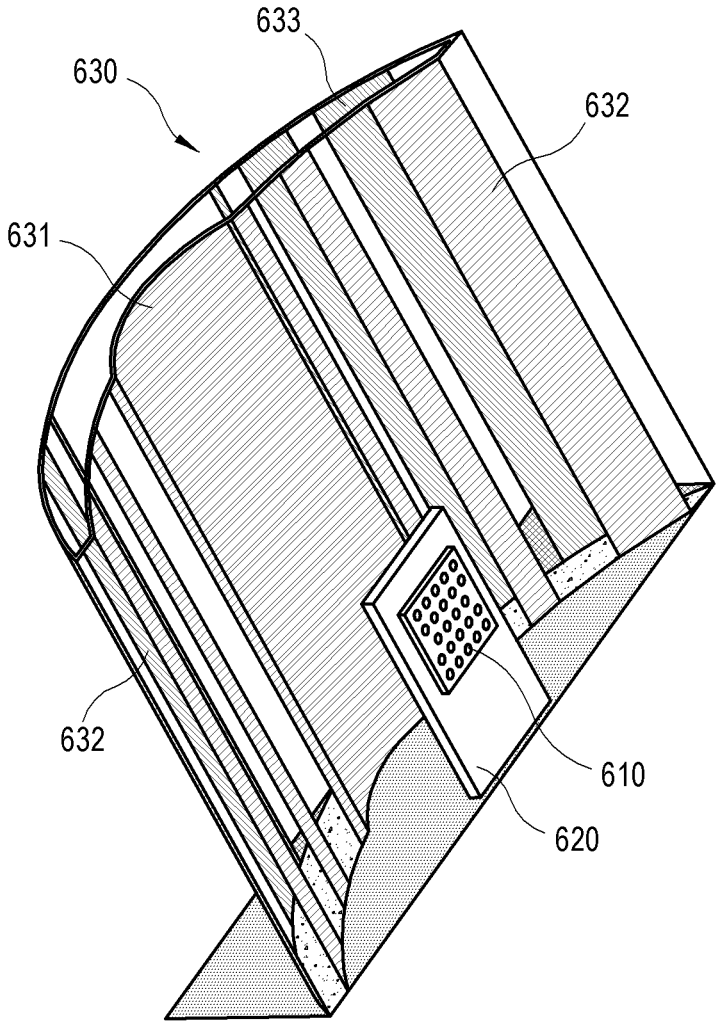
FIG. 6 is a perspective view showing the arrangement and structure of a radiation reinforcement member according to an embodiment of the disclosure.

FIG. 6 is a perspective view showing the arrangement and structure of a radiation reinforcement member according to an embodiment of the disclosure.

As shown in FIG. 6, a radiation reinforcement member 630 is arranged behind an antenna module 610 supported on a support 620. The radiation reinforcement member 630 includes a plurality of areas 631, 632 and 633 having not a single curvature but multiple different curvatures. The radiation reinforcement member 630, for example, may be formed with the reinforcement areas 631, 632 and 633 including the electric conductors at an outer side of a base which forms an outer appearance of the radiation reinforcement member 630 and includes the dielectric. The reinforcement areas 631, 632 and 633 may be adjacent to or spaced apart from each other.

At least some of the reinforcement areas 631, 632 and 633 are provided to have different curvatures, thereby comparatively improving the radiation gain as compared with that of when the radiation reinforcement member has a single curvature like the foregoing embodiments.

The reinforcement areas 631, 632 and 633 may be formed on the front of the radiation reinforcement member 630 facing the antenna module 610, or may be formed on the back opposite to the front of the radiation reinforcement member 630. Here, the front and the back of the radiation reinforcement member 630 are different in curvature, and therefore the reinforcement areas 631, 632 and 633 are formed on the front and the back so that the radiation reinforcement member 630 can have the reinforcement areas 631, 632 and 633 of more various curvatures. However, with such a structure, the other portions of the radiation reinforcement member 630 except the reinforcement areas 631, 632 and 633 are provided as a dielectric through which electromagnetic waves can pass.

Figure 7:
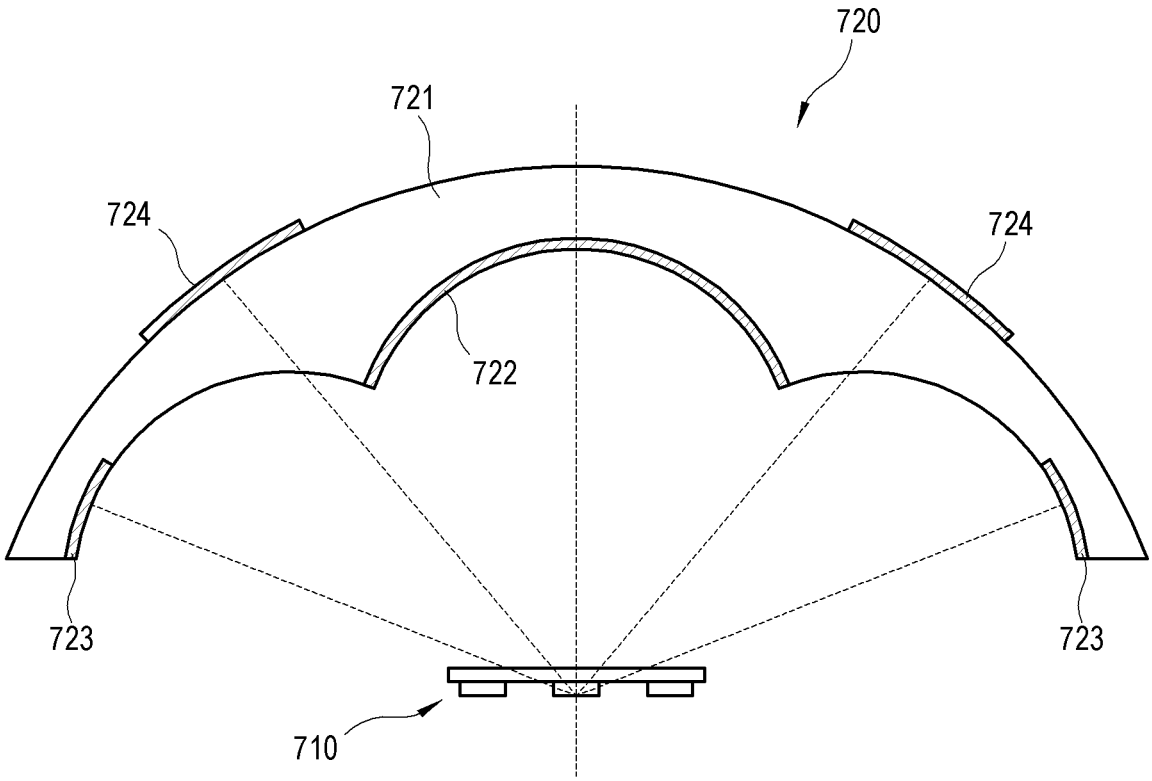
FIG. 7 is a plan view of a radiation reinforcement member of FIG. 6.

FIG. 7 is a plan view of a radiation reinforcement member of FIG. 6.

As shown in FIG. 7, a radiation reinforcement member 720 is installed behind an antenna module 710. In the radiation reinforcement member 720, a base 721 including a dielectric includes a central front surface having a first preset curvature, leftward and rightward front surfaces having a second preset curvature, and a back surface having a third preset curvature. Here, at least two among the first, second and third curvatures are different from each other.

Further, the radiation reinforcement member 720 includes a first reinforcement area 722 provided on the central front surface of the base 721, a second reinforcement area 723 provided on the leftward and rightward front surfaces of the base 721, and a third reinforcement area 724 provided on the back surface of the base 721. The reinforcement areas 722, 723 and 724 are formed on the outer surface of the base 721, and thus have curvatures corresponding to the outer surface of the base 721. The reinforcement areas 722, 723 and 724 include the electric conductors, and the curved surfaces of the reinforcement areas 722, 723 and 724 are arranged to surround the antenna module 710.

Here, straight lines connecting the antenna module 710 and the centers of the reinforcement areas 722, 723 and 724 may be spaced apart from each other. That is, a path of an electromagnetic wave is secured between the antenna module 710 and the reinforcement areas 722, 723 and 724, thereby improving the coupling effect based on the reinforcement areas 722, 723 and 724. In light of the antenna module 710, when the third reinforcement area 724 on the back of the base 721 overlaps with the first reinforcement area 722 or the second reinforcement area 723, the path of the electromagnetic wave between the third reinforcement area 724 and the antenna module 710 is interfered with the first reinforcement area 722 or the second reinforcement area 723. In this case, the coupling effect of the third reinforcement area 724 becomes marginal.

Therefore, in terms of the antenna module 710, the reinforcement areas 722, 723 and 724 are arranged not to overlap with each other if possible, in order to maximize the coupling effect.

Meanwhile, in the foregoing embodiments, the antenna module having a structure to which the radiation reinforcement member is applied is actualized as an independent antenna apparatus. However, there are no limits to the apparatus to which the concept of the disclosure is applied.

Figure 8:
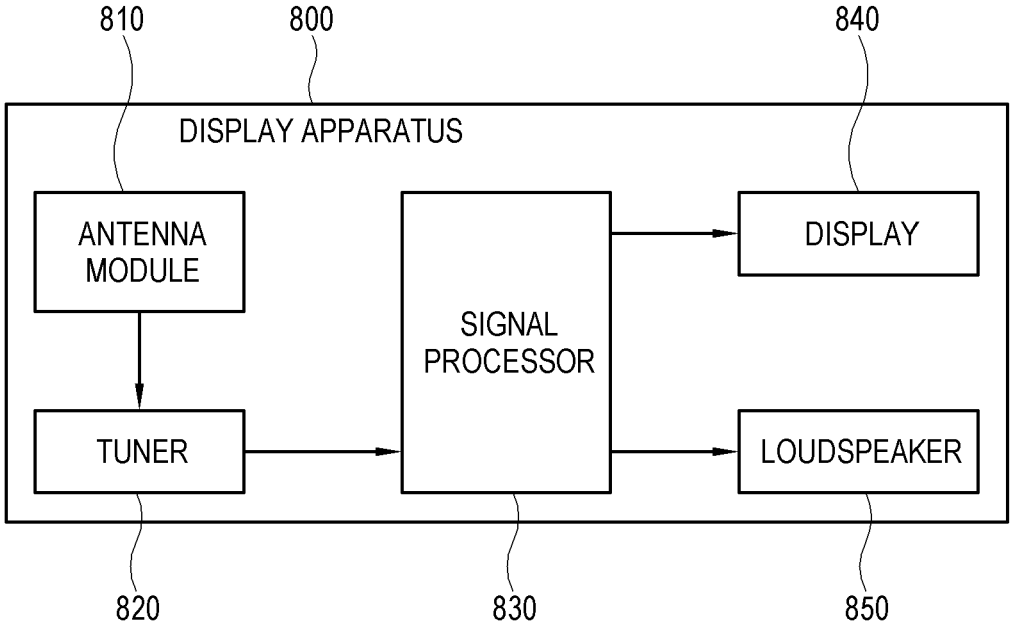
FIG. 8 is a block diagram of a display apparatus according to an embodiment of the disclosure.

FIG. 8 is a block diagram of a display apparatus according to an embodiment of the disclosure.

As shown in FIG. 8, a display apparatus 800 according to an embodiment of the disclosure is actualized by a TV, and includes an antenna module 810 to receive a broadcast signal, a tuner 820 to be tuned to a frequency of a specific channel for the broadcast signal received in the antenna module 810, a signal processor 830 to process the broadcast signal to which the tuner 820 is tuned, a display 840 to display a broadcast image based on the broadcast signal processed by the signal processor 830, and a loudspeaker 850 to output a broadcast sound based on the broadcast signal processed by the signal processor 830.

The antenna module 810 has the same structure and function as described in the foregoing embodiment, and additionally includes the radiation reinforcement member to improve the radiation gain. The radiation reinforcement member is equivalent to those of the foregoing embodiments, and therefore detailed descriptions thereof will be omitted.

The tuner 820 is tuned to a specific frequency for an RF signal received in the antenna module 810 and demodulates the RF signal. The tuner 820 is actualized by a hardware chipset that includes a tuning circuit to bed tuned to the RF signal, an analog digital converter (ADC) to convert a tuned analog signal into a digital signal, and a demodulator to demodulate the tuned digital signal. However, the ADC or the demodulator may be provided separately from the tuner 820.

The signal processor 830 for processing the demodulated digital signal according to various processes may be actualized by an SoC or signal processing board including a built-in module for performing each process. For example, the signal processor 830 includes a demultiplexer (deMUX), a decoder, a scaler, and the like module. Alternatively, the signal processor 830 may be designed to include a CPU in an SOC.

In the foregoing embodiments, the display apparatus 800 provided as a TV includes the antenna module 810. However, an apparatus including the antenna module 810 is not limited to the display apparatus 800, and may include home appliances such as refrigerator, etc. or a communication relay such as a hub, an access point (AP), a repeater, etc.

The methods according to the foregoing exemplary embodiments may be achieved in the form of a program command that can be implemented in various computers, and recorded in a computer readable medium. Such a computer readable medium may include a program command, a data file, a data structure or the like, or combination thereof. For example, the computer readable medium may be stored in a volatile or nonvolatile storage such as a ROM or the like, regardless of whether it is deletable or rewritable, for example, a RAM, a memory chip, a device or integrated circuit (IC) like memory, or an optically or magnetically recordable or machine (e.g., a computer)-readable storage medium, for example, a compact disk (CD), a digital versatile disk (DVD), a magnetic disk, a magnetic tape or the like. It will be appreciated that a memory, which can be included in a mobile terminal, is an example of the machine-readable storage medium suitable for storing a program having instructions for realizing the exemplary embodiments. The program command recorded in this storage medium may be specially designed and configured according to the exemplary embodiments, or may be publicly known and available to those skilled in the art of computer software.

Although a few exemplary embodiments have been shown and described, it will be appreciated by those skilled in the art that changes may be made in these exemplary embodiments without departing from the principles and spirit of the invention, the scope of which is defined in the appended claims and their equivalents.

The invention claimed is:

1. An antenna apparatus comprising:

an antenna module having a front surface which is a radiation-oriented surface, and a back surface opposite the front surface, and a plurality of antenna devices spaced apart from each other on the front surface so as to form a phased-array antenna to transmit and receive radio signals; and a radio-wave reinforcement member including an electric conductor having a concave surface with a center that is positioned behind the back surface so as to be behind the antenna module by a preset distance and that faces toward the antenna module, to amplify radiation performance of the phased-array antenna.

2. The antenna apparatus according to claim 1, wherein the preset distance does not exceed a focal distance of the concave surface.

3. The antenna apparatus according to claim 1, wherein the preset distance corresponds to a radiation length of the antenna module and a wavelength corresponding to an operation frequency of the antenna module.

4. The antenna apparatus according to claim 1, wherein the antenna module is provided to transmit and receive the radio signals based on a millimeter wave.

5. The antenna apparatus according to claim 1, further comprising a control circuit configured to individually adjust a phase of a voltage applied to the plurality of antenna devices.

6. The antenna apparatus according to claim 1, wherein the radio-wave reinforcement member further includes at least one additional electric conductor, each electric conductor of the at least one additional electric conductor having a concave surface with a center that is positioned behind the back surface so as to be behind the antenna module by a preset distance and that faces toward the antenna module, to amplify radiation performance of the phrased-array antenna, where each electric conductor of the electric conductor and the at least one additional electric conductor has a different curvature from each other.

7. The antenna apparatus according to claim 6, wherein the concave surfaces of each electric conductor of the electric conductor and the at least one additional electric conductor have different central axial lines with respect to the antenna module.

8. The antenna apparatus according to claim 6, wherein the radio-wave reinforcement member comprises a base comprising a dielectric, wherein the electric conductor and the at least one additional electric conductor include a first electric conductor formed on a front surface of the base facing the antenna module and having a first curvature, and a second electric conductor formed on a back surface of the base opposite to the front surface of the base and having a second curvature.

* * * * *